United States Patent [19]

Myer, II

[11] 4,343,570

[45] Aug. 10, 1982

[54] SELF-DRIVING SUPPORT ASSEMBLY

[76] Inventor: Charles R. Myer, II, 868 Hale St., Beverly Farms, Mass. 01915

[21] Appl. No.: 119,158

[22] Filed: Feb. 6, 1980

[51] Int. Cl.[3] ..... E02B 17/00; E02D 21/00

[52] U.S. Cl. ..... 405/229; 52/125.1; 405/196; 405/221; 405/228; 405/232

[58] Field of Search ..... 405/195, 196, 224, 227, 405/228, 229, 230, 232, 221; 52/126, 745; 254/93 R, 104

[56] References Cited

U.S. PATENT DOCUMENTS

| | | | |
|---|---|---|---|
| 202,415 | 4/1878 | Cumming . | |
| 1,419,868 | 6/1922 | Levitan . | |
| 2,170,690 | 8/1939 | Mafera | 254/104 |
| 2,354,936 | 8/1944 | Bignell . | |
| 2,775,869 | 1/1957 | Pointer . | |
| 2,858,055 | 10/1958 | DeLong et al. . | |
| 2,861,430 | 11/1958 | Bauer et al. . | |
| 2,867,111 | 1/1959 | Youtz | 254/93 R X |
| 2,877,629 | 3/1959 | DeLong et al. . | |
| 2,906,100 | 9/1959 | DeLong et al. . | |
| 2,942,425 | 6/1960 | DeLong et al. . | |
| 2,975,560 | 3/1961 | Leonard | 52/125.1 |
| 2,976,693 | 3/1961 | Showalter et al. . | |
| 3,065,573 | 11/1962 | Goldberg | 52/125.1 |
| 3,230,721 | 1/1966 | DeLong et al. . | |
| 3,283,516 | 11/1966 | DeLong et al. . | |
| 3,380,257 | 4/1968 | Gillman et al. . | |
| 3,614,871 | 10/1971 | Nordell . | |
| 3,839,875 | 10/1974 | Matsushita . | |
| 3,846,991 | 11/1974 | Wisotsky | 405/228 |
| 3,851,490 | 12/1974 | Matsushita . | |
| 3,852,970 | 12/1974 | Cassidy | 405/230 |
| 3,871,181 | 3/1975 | DeLong . | |
| 3,950,954 | 4/1976 | Haug | 405/228 |
| 3,953,980 | 5/1976 | Bennett . | |
| 3,972,198 | 8/1976 | Maly et al. . | |
| 4,075,860 | 2/1978 | Hansen . | |

FOREIGN PATENT DOCUMENTS

| | | |
|---|---|---|
| 600129 | 4/1948 | United Kingdom . |

*Primary Examiner*—David H. Corbin

*Attorney, Agent, or Firm*—Richard P. Crowley

[57] ABSTRACT

The present invention is directed to a support system and method which permits the self-driving supporting columns after the structure has been fully assembled in place and which utilizes the gravitational force acting on this structure to achieve self-driving of the columns in a predetermined direction (e.g., vertically). In this manner, pile driving, predrilling deepholes or preparation of concrete footings can be avoided. The support system of the present invention is also provided with means for resisting movement of the columns out of alignment with the predetermined direction as they are self-driven into the substrate and means for maintaining the structure in a predetermined elevation (e.g., horizontal) as the columns are driven. The system can also include many means for maintaining the structure at a predetermined height relative to the substrate over which it is supported.

25 Claims, 7 Drawing Figures

FIG. 7
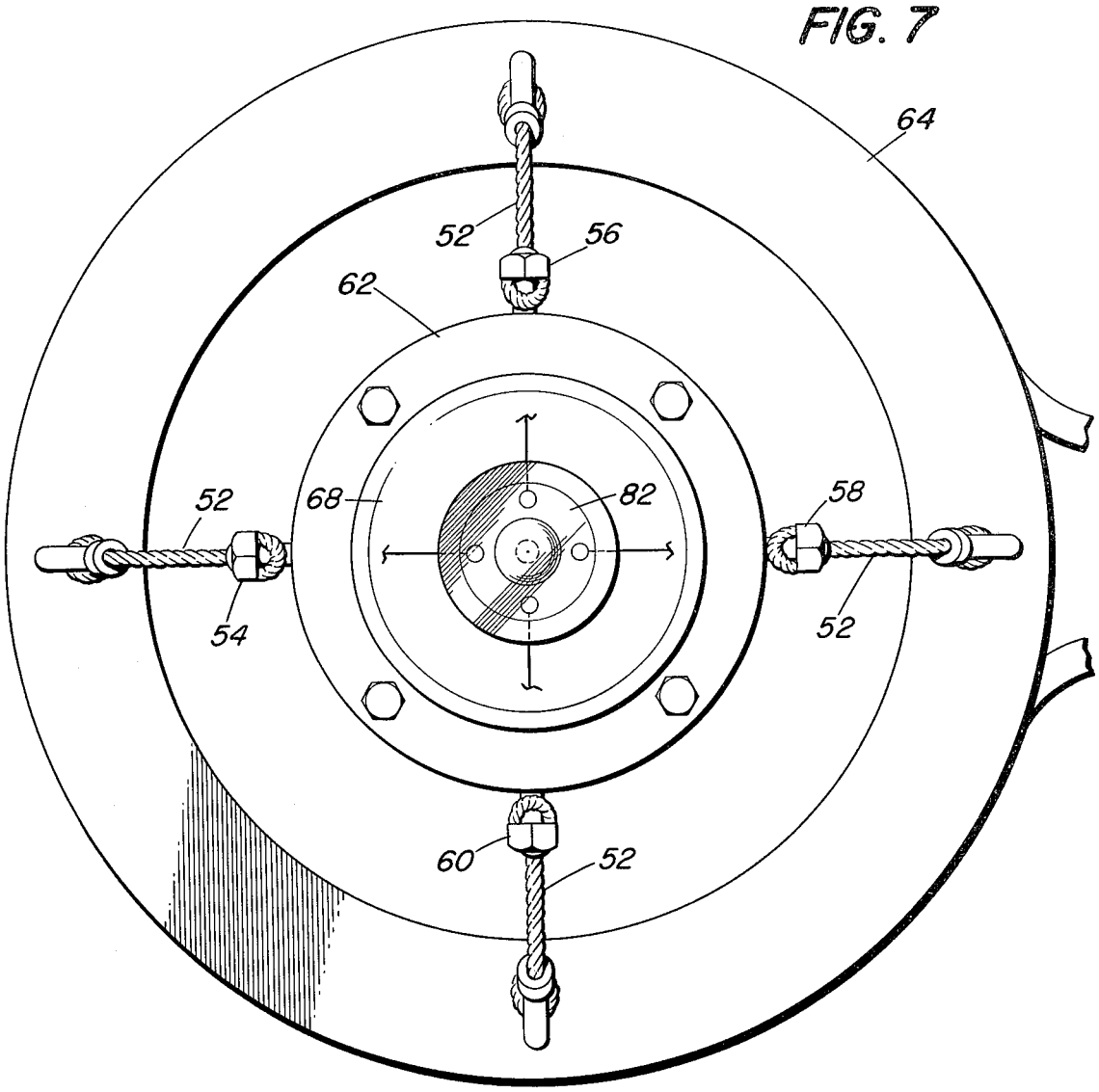
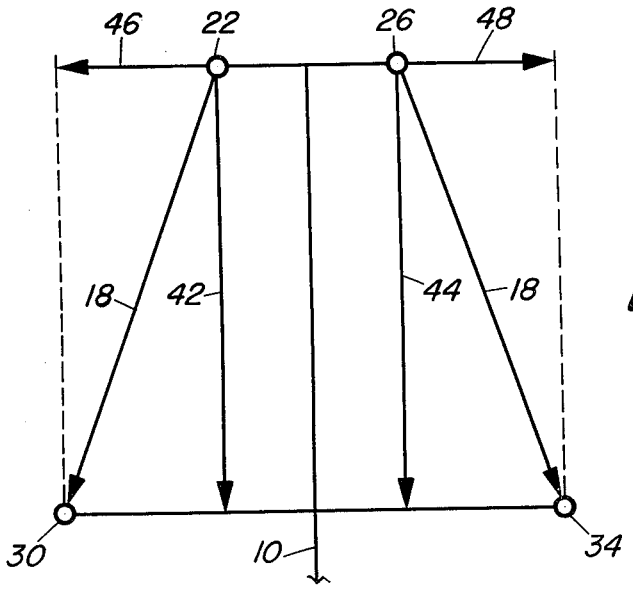
FIG. 5

SELF-DRIVING SUPPORT ASSEMBLY

The present invention relates to support systems for static structures and, more particularly, to a system utilizing self-driving pilings of columns.

Typically, static structures such as elevated buildings, bridges, decks platforms and the like are supported over a substrate by pilings or columns which are secured in the substrate by various techniques. Depending on the load and the type of structure, conventional construction techniques include drilling of deep holes to receive the pilings, pile driving with heavy mechanical equipment or anchoring the piles in concrete footings. While these techniques are generally suitable in most situations, they are not suitable in all cases.

All the conventional techniques generally require on-site utilization of heavy construction equipment such as augers, pile drivers, concrete mixing trucks and the like. In many cases the location of a desired construction site will not permit the use of such equipment. The site may be remotely located such as in a mountainous region or on an island. Similar problems of equipment accessibility often arise on very steeply sloped terrain. Other areas, which may be accessible to heavy equipment, nevertheless comprise park land, wild-life refuges or the like in which concerns for preservation of the ecological balance dictate against the use of such equipment. Many smaller construction projects may also be rendered economically infeasible due to the high costs associated with conventional support anchoring techniques. Moreover, these conventional techniques generally involve highly energy intensive methods and equipment. Thus, there is a significant unsatisfied need for a static structure support system which can be used in circumstances of the type just described and which does not possess the disadvantges of the prior art support systems.

Accordingly, it is an object of the present invention to provide a system for supporting static structures which does not suffer from the drawbacks of the prior art systems.

More specifically, it is an object of the present invention to provide a system for supporting elevated buildings, bridges, decks, platforms and the like over penetrable substrates which does not require the use of heavy construction techniques.

It is another object of the present invention to provide a system for supporting static structures in locations such as swamps, bogs, sand dunes, tidal areas, tundra, steeply sloped areas, on islands and in ecologically sensitive areas, which locations are not suited to the use of conventional support techniques.

It is another object of the present invention to provide a support system for a static structure utilizing at least one column and an associated suspension mechanism which utilizes the force of gravity acting on the structure (i.e., its weight)—in the form of components which are parallel and perpendicular to the axis of this column—to drive the column in a predetermined direction and to maintain the path of the column in this predetermined direction as it is driven into a substrate.

It is also an object of the present invention to provide a self-driving support system with associated means for automatically sensing and controlling any deviation from the predetermined direction by the support column.

Another object of the present invention is to provide a support system for static structures in which the position of the structure along the column can be adjusted to keep the structure in a predetermined elevation.

It is also an object of the present invention to provide a support system for static structures which maintains the structure at a predetermined height relative to the substrate over which it is supported.

These and other objects of the invention are achieved by providing a self-driving support assembly for supporting a structure over a penetrable substrate, the assembly comprising a support member secured to the structure and having a passage therethrough; a column extending through the passage in the support member, the column having on its lower end means for penetrating the substrate; a plurality of tensile suspension members for suspending the structure from the column, each of the suspension members secured at its upper end to the column and at its lower end to the support member, the weight of the structure being applied to the column as tensile forces acting along the suspension members, the components of the tensile forces parallel to the axis of the column serving to drive the column into the substrate in a predetermined direction and any net component of the tensile forces which is perpendicular to the axis serving to resist the movement of the column out of alignment with the predetermined direction; first adjusting means operatively associated with the suspension members for adjusting the relative magnitudes of the tensile forces in each suspension member; second adjusting means for adjusting the position of the structure along the column.

The present invention also provides a process for supporting a static structure over a penetrable substrate which comprises the steps of suspending the structure from a plurality of suspension points around a column, the weight of the structure being applied to the column as tensile forces acting along suspension members, the components of the tensile forces parallel to the axis of the column serving to drive the column into the substrate in a predetermined direction; maintaining the column in alignment with the predetermined direction as the column is self-driven into the substrate; and adjusting the position of the structure along the column as the column is self-driven into the substrate to maintain the structure in a predetermined elevation.

In the drawings,

FIG. 5 is a vector analysis diagram showing the resolution of forces at two suspension points in a support system of the type shown in FIGS. 3 and 4.

FIG. 7 is a top plan view of the support assembly shown in FIG. 6.

Figure 1:
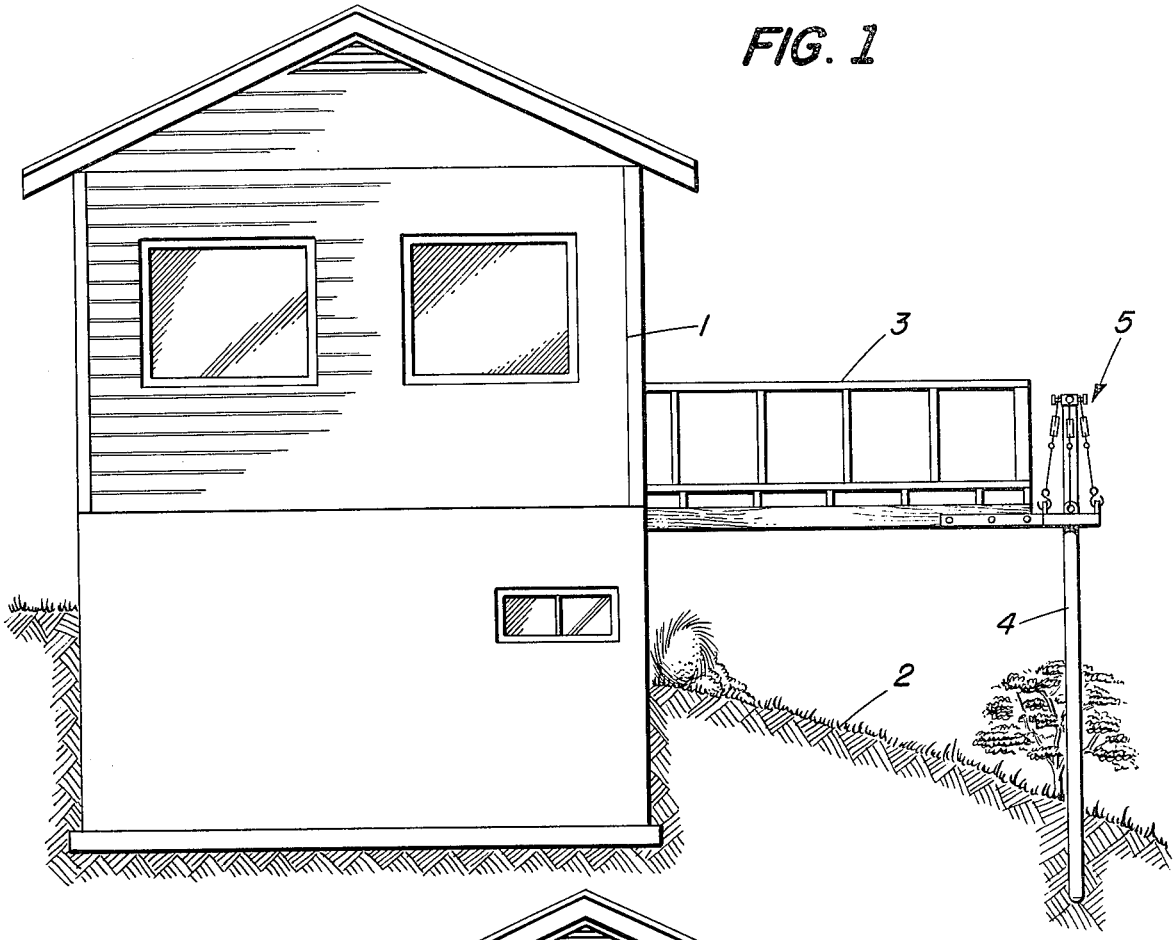
FIG. 1 is a side elevation view showing the self-driving support system of the present invention in use as a support for a deck structure.

The present invention is directed to a support system and method which permits the self-driving of supporting columns after the structure has been assembled in place and which utilizes the gravitational force acting on this structure to achieve self-driving of the columns in a predetermined direction (e.g., vertically). In this manner, pile driving, predrilling deepholes or preparation of concrete footings can be avoided. The support system of the present invention is also provided with means for resisting movement of the columns out of the alignment with the predetermined direction as they are self-driven into the substrate and means for maintaining the structure in a predetermined position, i.e., a fixed relationship to some external reference point or points such as a generally horizontal plane, as the columns are driven. The system can also include many means for maintaining the structure at a predetermined height relative to the substrate over which it is supported.

The structures which can be constructed utilizing the support system of the present invention include, inter alia, elevated buildings, bridges, piers, decks, docks, platforms, and pipelines. The system of the present invention is particularly advantageous for the erection of the above-mentioned structures in diverse locations such as in swamps, bogs, tidal areas, on islands, on sand dunes, tundra, steeply sloped regions, mountainous regions and the like. The substrates over which these structures are supported according to the present invention can consist of any material which is penetrable by the columns or piles under the self-driving conditions described in more detail hereinafter.

According to the present invention, self-driving of the column and maintaining this column in predetermined alignment are both accomplished primarily through proper resolution of the tension forces created in the suspension system by the force of gravity acting on the structure. The tension forces are capable of being resolved into components which are parallel to the column axis and components which are perpendicular to the column axis. The parallel components of force are used to drive the column into the substrate, while any net perpendicular component is used to keep the column in proper alignment. Self-driving in this manner will continue until the friction forces on the column portion in the substrate are equal to the parallel components or until an impenetrable layer is reached by the foot of the column.

During self-driving in the described manner the column may tend to go out of the predetermined alignment if the foot of the column contacts rocks or other debris in the path of sinking or comes to rest on a sloping impenetrable sublayer. By resolving the tension forces acting on the column through the suspension system in the manner later described, a net component perpendicular to the column axis can be used to resist movement of the column out of the predetermined direction. In addition, the present invention provides means for adjusting the magnitude of this component of force to assist in urging the column back into proper alignment. These adjustments can be effected manually or automatically.

In the preferred form of this invention, it is desired to suppot a generally horizontal structure such as a deck or elevated building on substantially vertical columns. In this embodiment the resulting tension forces can be resolved into vertical and horizontal components. It is contemplated, however, that structures may be supported in an inclined plane, e.g., bridge approaches, and that columns with inclined orientations may be used. It will be recognized that in the case of free standing structures, the use of non-vertical columns will be limited to designs in which there are no net lateral forces imparted to the structure by these columns. The present invention will now be described with reference to the preferred embodiment, i.e., utilizing substantially vertical columns to support a substantially horizontal structure.

FIG. 1 shows a house 1 constructed on steeply sloped terrain 2 and which has a deck 3 partially supported at its outer end by substantially vertical column 4. The deck is suspended on column 4 by a support assembly shown generally at 5. The force of the deck weight is transmitted to the column by the support assembly and the resulting tension forces can be resolved into vertical components which act to self-drive the column vertically into the substrate and horizontal components which tend to keep the orientation of column 4 vertical as it sinks. As the column sinks, the outer edge of deck 3 also would tend to sink causing the deck to go out of the generally horizontal plane in which it was originally supported. In a manner described below the outer deck edge is raised as the column sinks to keep the deck horizontal.

Figure 2:
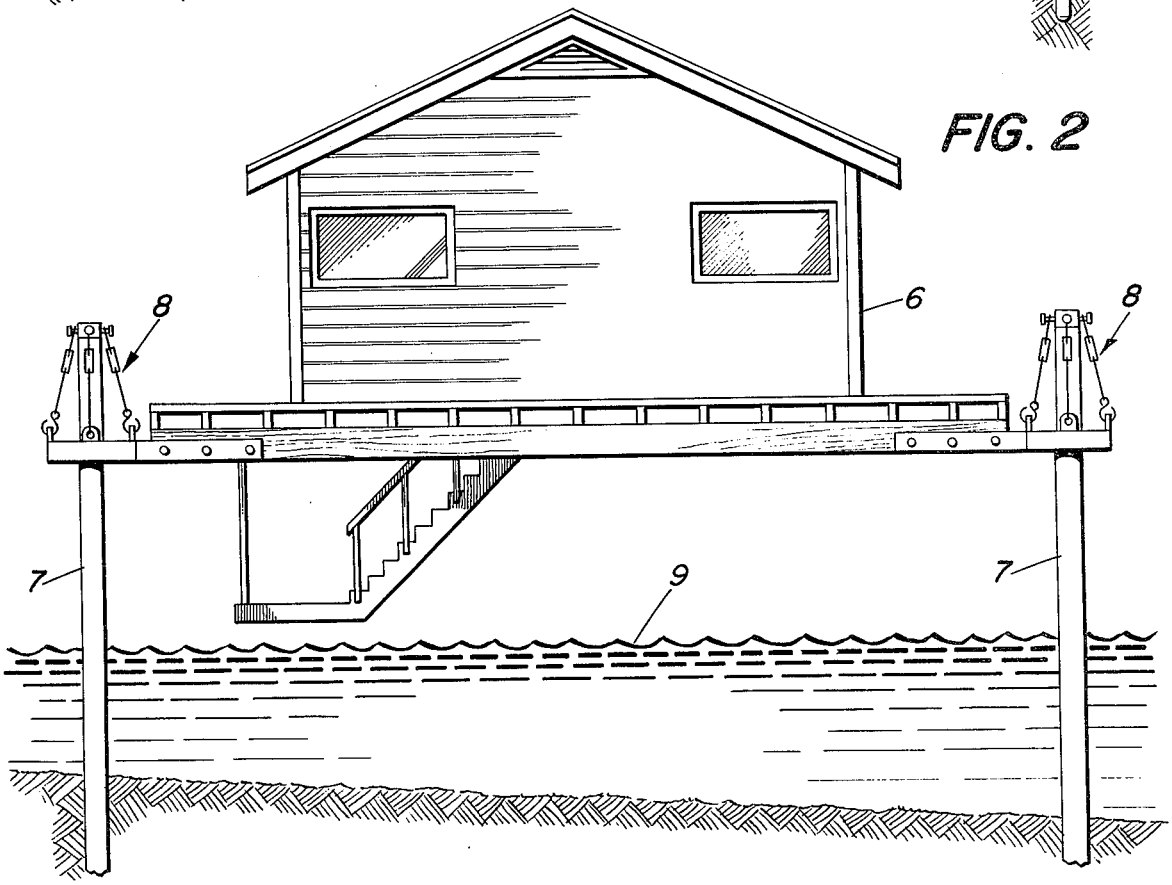
FIG. 2 is a side elevation view showing the self-driving support system of the present invention in use as a support for an elevated free-standing structure.

FIG. 2 shows another application of the support system of the present invention. Free standing structure 6 is supported at each corner by a generally vertical column 7 and employs a suspension assembly 8 operating in the same manner as the ones in FIG. 1. In this application the structure is provided with adjusting means to keep it level, i.e., horizontal and also with means to keep it a predetermined height above the surface of water 9.

Figures 3, 4:
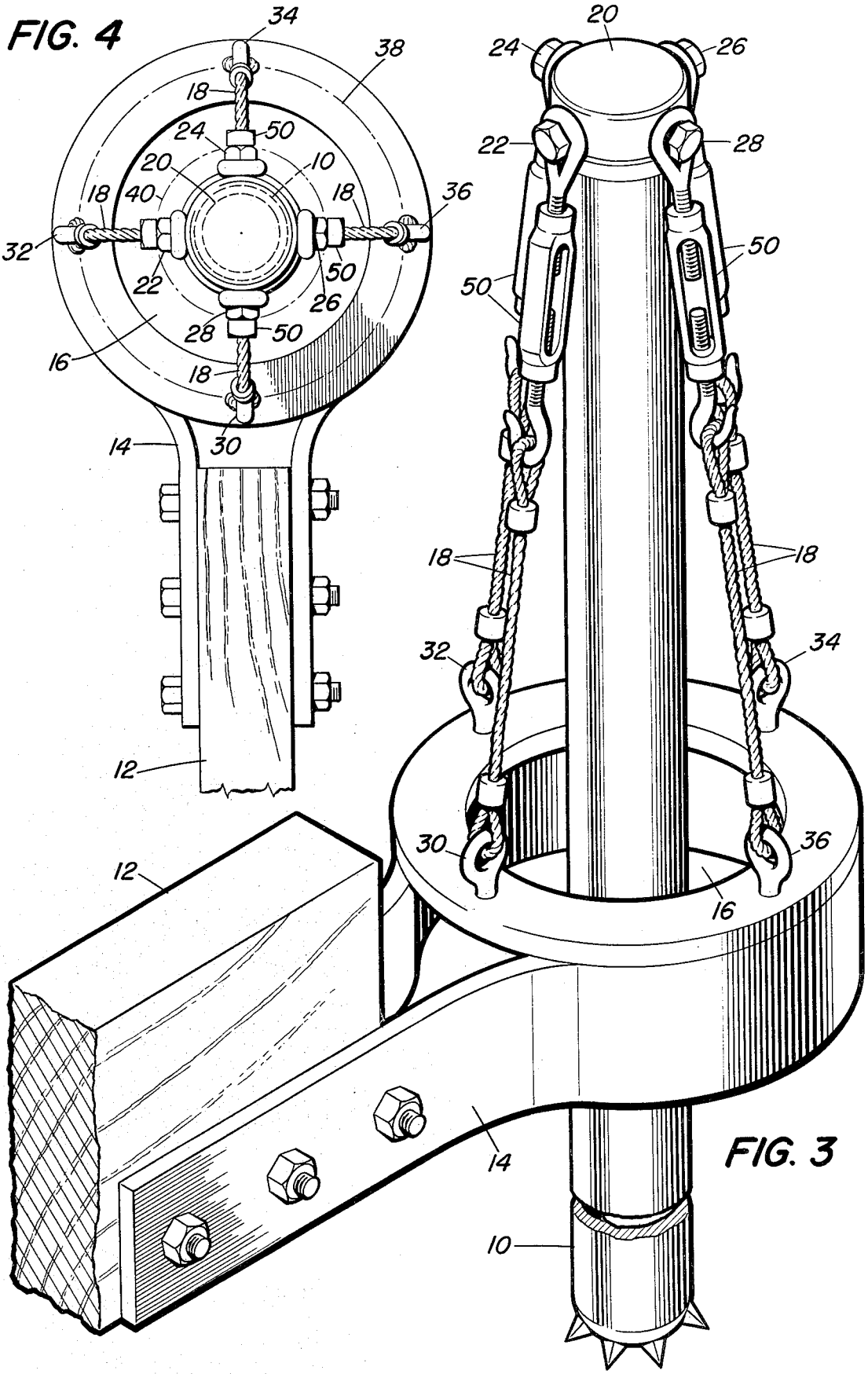
FIG. 3 is a perspective view showing one form of the self-driving support assembly of the present invention.
FIG. 4 is a top plan view of the support assembly shown in FIG. 3.

FIGS. 3 and 4 show the details of one support system useful in the construction of static structures over terrain which defies traditional construction techniques. In these Figures a vertical load bearing member 10 is the basic support element. This member can be a column, piling or the like of any suitable cross-sectional design. The size, shape and materials employed for this vertical load bearing member may vary widely and generally are dictated by the particular application in which it is being used. The column has at its lower end means for penetrating the substrate such as a pointed segment. In a preferred embodiment the column foot is provided with carbide chips embedded in the lower surface which serve to facilitate penetrating and to prevent the column from slipping sideways. An element of the static structure to be supported is represented by horizontal beam or joist 12 which forms a part of the deck framing. Attached to joist 12 is a support member or yoke 14 containing a passage 16 therethrough, best seen in FIG. 4. When in substantial vertical disposition, column 10 passes through passage 16 in support member 14 without touching the support member. As will be readily apparent to one skilled in the art, the support member may be a collar completely surrounding the column as shown in FIGS. 3 and 4 or may comprise a yoke structure which only partially enclosed the column as long as a passage is provided for unrestrained movement of the column through the support member.

In the embodiment shown in FIGS. 3 and 4 a plurality of suspension means 18, shown as cables, are used to suspend the load from column 10. Other suspension means such as ropes, chains, wires, rods and the like may, of course, be utilized. These suspension means are attached at the upper ends thereof to a cap assembly 20 which fits on the upper end of column 10 and which is provided with four connection points 22, 24, 26 and 28 for attaching the suspension means. While four suspension means are shown, any number over two can be employed. To achieve maximum adjustability as described below, it is preferred to employ at least four suspension means. The suspension means 18 are connected at the other end thereof to support member 14 at positions 30, 32, 34 and 36. As best seen in FIG. 4, the imaginary circle 38 connecting attachment points 30, 32, 34 and 36 has a larger diameter than circle 40 drawn through attachment points 22, 24, 26 and 28 at the column cap. As seen in FIG. 5, suspension means 18 carry tension forces which have components in the vertical direction (42, 44) and in the horizontal direction (46, 48) (only 2 points are shown). While all the suspension attachment points are shown equidistant from the axis of column 10, this is not required. Off-center placement of these attachment points will affect the resolution of forces discussed below.

While the suspension means have been illustrated at a particular angle in the Figures, it will be appreciated that any angle of suspension can be employed. Where the suspension members are parallel to the column axis the component of the tension force which is perpendicular to the column axis will have a magnitude of zero. Any movement of the column out of alignment, however, will result in a tilting of the column and suspension harness and therefore a horizontal restoring force component will be created.

In order to facilitate the self-aligning features of the support system of the present invention, suspension members 18 may be associated with means for adjusting the relative magnitude of the tensile forces in each suspension member to create a net horizontal component acting on the column. In the simplest form, as shown in FIGS. 3 and 4, the adjusting means can comprise turnbuckles 40. It is also within the scope of the present invention to provide automatic control of the tension forces created in the suspension members to achieve the desired results. This can be effected by providing automatic adjusting means actuated by means for sensing movement out of generally vertical disposition by the column. The sensing means can comprise a level or similar device.

While the suspension members shown in FIGS. 3 and 4 are attached to a mounting cap at the top of the column, it is, of course, possible to attach the upper end of the suspension members either directly to the column or to an annular collar or similar device mounted on the column at some point below the column top. As the column self-drives into the substrate, the structure itself which is supported on the column will also tend to sink. In the case of a deck or other structure which is only partially supported by columns, one portion of the structure will tend to go out of the generally horizontal support plane. In the case of a structure fully supported by pilings, uneven resistance forces may cause different rates of driving which can result in tilting of the structure out of the horizontal support plane. Moreover, in fully supported structures such as a house in a tidal area, there may be a predetermined height above the substrate or high tide levels below which even uniform sinking of the structure is not desired.

Accordingly, means should be associated with the column suspension assembly to adjust the position of the structure along the column, i.e., to raise the structure on the column to return it to a predetermined elevation such as horizontal. This result can be achieved by utilizing various mechanical devices. For example, means can be provided to elevate the points where the suspension members attach to the columns. According to this manner of operation a slidably adjustable collar containing these attachment points can be moved up to offset any sinking of the column. If these attachment points are fixed (as shown in FIGS. 3 and 4) the same result can be achieved by extending the column length as it sinks. Extension can be effected by adding lengths of column (i.e., by threaded couplings, etc.) or by providing the column with telescoping-type means for automatically extending the length. Alternatively, means can be provided for shortening the suspension members to achieve the same result. In the embodiment shown in FIGS. 3 and 4 a uniform tightening of all turnbuckles would have the effect of shortening the suspension members. In general the movement of an attachment ring or telescoping member to elevate the structure can be accomplished by using various mechanical devices such as a hydraulic jack, a screw jack, a rachet and pawl or a rack and pinion arrangement.

Where maintaining a fully supported structure at a predetermined height relative to the substrate is desired, means can be provided to sense the approach of this level as the structure sinks. These sensing means can be operatively associated with the same adjusting means utilized to keep the structure horizontal at any given column location. In this case, however, uniform raising of the entire structure at all column locations may be necessary.

Figure 6:
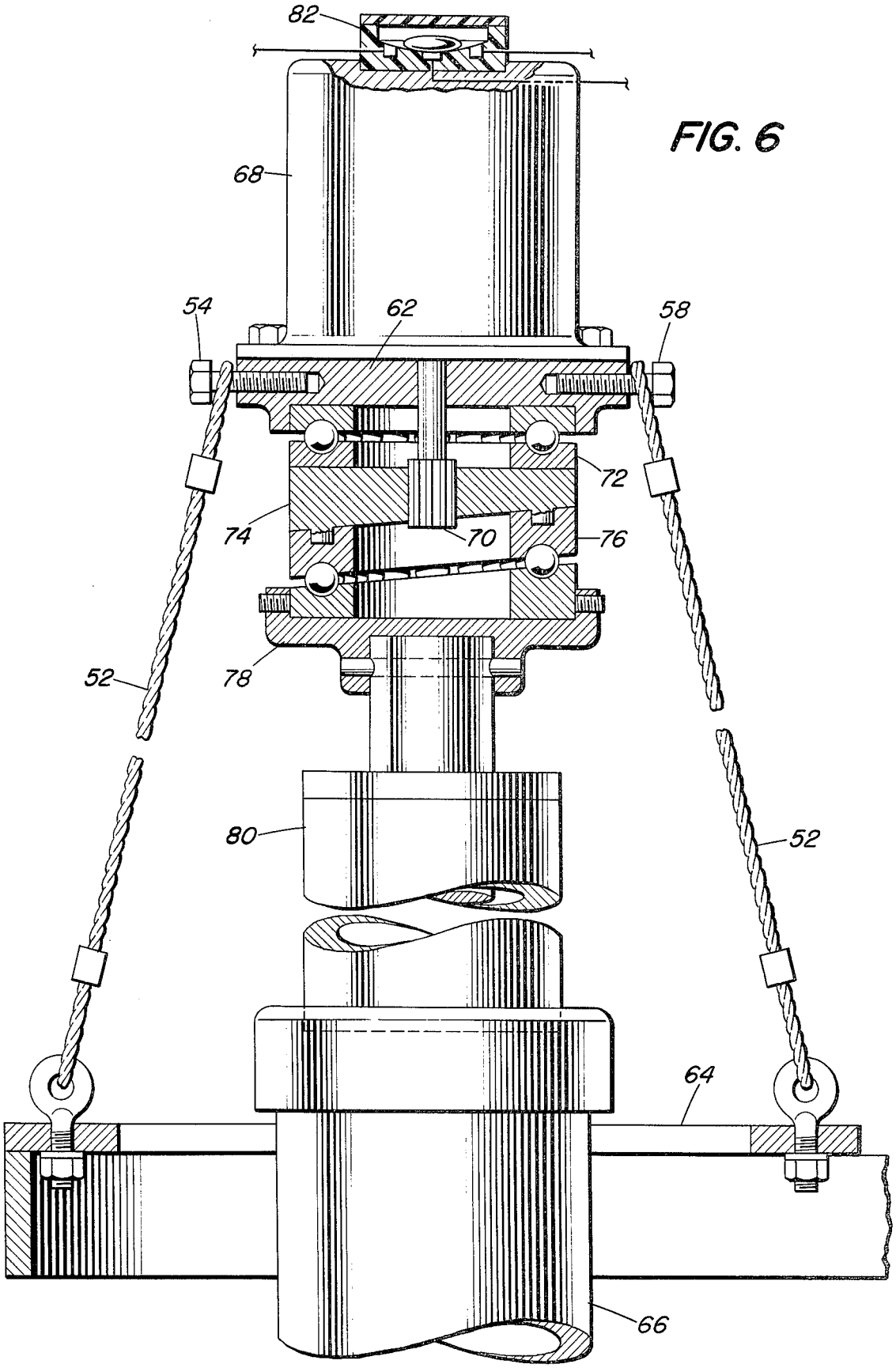
FIG. 6 is a side elevation view, partially in section, of another form of the self-driving support assembly of the present invention.

FIGS. 6 and 7 show another embodiment of the present invention. Suspension members or cables 52 are secured at the upper ends thereof to connectors 54, 56, 58 and 60 which are mounted on top piece 62. At their lower ends cables 52 are secured to a support member or yoke 64 through which the column 66 passes in the manner described with respect to FIG. 3. The apparatus is provied with a low speed, high torque motor 68 which is coupled via drive shaft 70 through top plate 62 and through an upper ball bearing 72 to a nonparallel or skewed disk 74. Disk 74 rests on lower ball bearing 76 which seats on hydraulic ram 78 which is actuated by a hydraulic cylinder 80. An automatic mercury leveling device 82 is provided on top of the unit to sense movement out of vertical by the column and to actuate motor 68. The motor causes nonparallel disk 74 to rotate to a position which changes the relative tension in cables 52 to create net horizontal components of force of sufficient magnitude to bring the column back to substantially vertical. The control unit is also provided with means for sensing vertical movement of the deck or platform out of the substantially horizontal support plane which is caused by the self-driving of the column. Suitable means for sensing this movement include electronic bubble levels and the like. Signals from these sensing means are supplied to hydraulic cylinder 80 to raise the entire suspension assembly and thus the structure back into generally horizontal disposition. A third sensing device (not shown) can be employed in conjunction with the hydraulic cylinder to maintain the deck or platform a predetermined height above the surface of the supporting substrate or water covering the substrate.

While means for adjusting the relative magnitude of the tensile forces in the suspension members have been illustrated in the manual mode as turnbuckles and in the automatic mode as the device shown in FIGS. 6 and 7, other means for adjusting the tension in these suspension members can be employed. While the support system of the present invention has been described as a single unit, it will be readily apparent that the static structure to be supported will utilize a plurality of support assemblies according to the present invention.

In operation according to the preferred embodiment a structure to be supported is assembled with the vertical pilings supporting the weight of the structure. In order to facilitate the assembly step the columns or pilings may be preset some minimal distance into the substrate. The suspension members serve to transmit the gravitational force acting on the structure into tension forces which can be resolved into vertical components which self-drive the column into the substrate and horizontal components which resist the movement of the column out of vertical. If the column does go out of vertical, the tension in the appropriate suspension member can be increased thereby increasing the horizontal components of that force to create a net restoring horizontal force. Thus, if the column foot has moved to the right, increasing the tension on the right side of the column will create a net horizontal force acting in direction to the right at the attachment point. This horizontal force is effective, as the column continues to sink, to return the column to vertical by acting to move the column foot to the left as the column pivots around an effective fulcrum located at or below the surface of the substrate.

While certain specific embodiments of the invention have been described with particularity herein, it should be recognized that various modifications thereof will occur to those skilled in the art. Therefore, the scope of the invention is to be limited solely by the scope of the appended claims.

I claim:

1. A self-driving support assembly for a structure over a penetrable substrate, said assembly comprising:

(a) a support member secured to said structure and having a passage therethrough;

(b) a column extending through said passage in said support member;

(c) a plurality of over two suspension members for suspending said structure from said column, each of said suspension members secured at its upper end to said column and at its lower end to said support member, and extending angularly and nonvertically from the axis of the column, the weight of said structure being applied to said column as tensile forces acting along said suspension members, the components of said tensile forces parallel to the axis of said column serving to drive said column into said substrate in a predetermined direction, and any net component of said tensile forces which is perpendicular to said axis serving to resist the movement of said column out of alignment with said predetermined direction; and (d) first adjusting means operatively associated with said suspension members for adjusting the relative magnitudes of the tensile forces in each suspension member, to return to the predetermined direction of said column whereby, by adjusting the magnitude of the tensile force to maintain the predetermined direction, the column is self-driven by the weight of the structure into the penetrable substrate.

2. The self-driving support of claim 1 wherein said column has a substantially vertical predetermined direction.

3. The self-driving support assembly of claim 1 which includes a second adjusting means for adjusting the vertical position of said structure relative to said column, to maintain said structure a predetermined vertical distance over the substrate.

4. The self-driving support assembly of claim 3 wherein said second adjusting means maintains said structure in a substantially horizontal position.

5. The self-driving support assembly of claim 1 wherein said support member comprises an annular collar surrounding said column.

6. The self-driving support assembly of claim 1 wherein said suspension members comprise cables.

7. The self-driving support assembly of claim 1 wherein said suspension members are secured to said column by means of a cap assembly mounted on the upper end of said column, and the suspension members extend angularly outwardly from the cap assembly and the axis of said column.

8. The self-driving support assembly of claim 1 wherein said suspension members are secured to said column and said support member at points substantially equidistant from the axis of said column.

9. The self-driving support assembly of claim 1 wherein said first adjusting means comprises turnbuckles disposed in said suspension members.

10. The self-driving support assembly of claim 1 wherein said first adjusting means comprises means for automatically increasing the tension of at least one of said suspension members.

11. The self-driving support assembly of claim 1 further comprising means for maintaining said structure at a predetermined height relative to said substrate.

12. The self-driving support assembly of claim 1 wherein said column additionally contains means for extending the column length.

13. The self-driving support assembly of claim 1 wherein said suspension member comprises four suspension members generally equidistantly spaced about the axis of said column, the suspension members extending angularly outwardly from the axis of said column.

14. The self-driving support assembly of claim 1 which includes:

(a) sensing means to sense the movement of said column from the predetermined direction; and (b) wherein the first adjusting means comprises a low-speed, high-torque motor actuated by the sensing means, to adjust the tension of the suspension members, when said column moves away from the predetermined direction, so as to maintain said column in said predetermined direction, by maintaining the desired magnitude of the components of the tensile force in the suspension members.

15. The self-driving support assembly of claim 1 wherein the first adjusting means includes:

(a) a low-speed, high-torque motor positioned on top of said column; and (b) a rotatable skewed disc element positioned beneath and driven by the motor, the disc element rotatable by the motor about the axis of the column, and the disc element skewed from the perpendicular plane to the axis of the said column, whereby, on actuation of the motor, the skewed disc element rotates to a position to change the relative magnitude of the tension force in the suspension members, to maintain said column in the predetermined direction.

16. A self-driving support assembly for supporting a structure over a penetrable substrate, said assembly comprising:

(a) a support member which includes a collar having a passageway therethrough, the support member secured to said structure;

(b) a column extending in a movable manner through said passageway in said collar, said column having on its lower end means for penetrating said substrate;

(c) a cap assembly mounted toward the upper end of said column;

(d) a plurality of over two cable tensile suspension members for suspending said structure from said column, each of said cable suspension members secured at each upper end of said cap assembly and extending angularly outwardly from the axis of the column and extending and secured at its lower end to said collar support member, the weight of said structure being applied to said column as tensile forces acting along said cable suspension members, the components of said tensile forces parallel to the axis of said column serving to drive said column into said substrate in a generally vertical direction, and any net components of said tensile forces, which are perpendicular to said axis serving to resist the movement of said column out of alignment of said generally vertical predetermined direction; and (e) first adjusting means comprising turnbuckles disposed in each of said cable suspension members, for adjusting the relative magnitude of the tensile forces in each cable suspension member, to maintain the predetermined vertical direction of said column, whereby, by adjusting the magnitude of the tensile forces on the cable suspension members by adjusting the turnbuckles, to retain said column to the predetermined generally vertical direction, the column is self-driven by the weight of the structure into the penetrable substrate.

17. A self-driving support assembly for supporting a structure over a penetrable substrate, said assembly comprising:

(a) a support member which includes a collar having a passageway therethrough, the support member secured to said structure;

(b) a column extending in a movable manner through said passageway in said collar, said column having on its lower end means for penetrating said substrate;

(c) a cap assembly mounted toward the upper end of said column;

(d) a plurality of over two cable tensile suspension members for suspending said structure from said column, each of said cable suspension members secured at each upper end of said cap assembly and extending angularly outwardly from the axis of the column and extending and secured at its lower end to said collar support member, the weight of said structure being applied to said column as tensile forces acting along said cable suspension members, the components of said tensile forces parallel to the axis of said column serving to drive said column into said substrate in a generally vertical direction, and any net components of said tensile forces which are perpendicular to said axis serving to resist the movement of said column out of alignment of said generally vertical predetermined direction; and (e) first automatic adjusting means for increasing automatically the tensile forces of the suspension members, which means comprises:

(i) sensing means to sense the movement of said column from the generally vertical predetermined direction, (ii) a low-speed, high-torque motor actuated by the sensing means, the motor positioned on top of the column, and (iii) a rotatable disc element in said column beneath said motor and driven by said motor, the disc element rotatable by the motor, on actuation by the sensing means, the disc element rotatable about the axis of said column and skewed from the perpendicular plane to the axis of said column, whereby, on actuation of the motor, the skewed disc element rotates to a position to change the relative tension in the cable suspension members, to return said column to the generally vertical predetermined direction.

18. A method of self-driving a column secured to a structure into a penetrable substrate by the weight of the structure, which method comprises:

(a) suspending said structure by a plurality of over two suspension members about a plurality of suspension points around said column, the suspension members extending angularly and nonvertically from the axis of the column, to define a downward, vertical tensile force component parallel to the axis of the column and a horizontal tensile force component perpendicular to the axis of the column;

(b) employing the downward tensile force component to drive one end of said column in a generally vertical predetermined direction into the penetrable substrate; and (c) adjusting in each suspension member, as required, the magnitude of the tensile force components of said suspension members, to maintain the predetermined generally vertical direction of the column, to drive the column downwardly by the weight of said structure.

19. The method of claim 18 which includes maintaining said structure in a substantially horizontal predetermined position.

20. The method of claim 18 which includes sensing any movement of said column out of alignment with the generally vertical predetermined direction and adjusting the relative magnitude of the tensile forces in each suspension member, to provide a desired net component of these tensile forces which is perpendicular to the axis of said column.

21. The method of claim 18 which includes adjusting the height of said structure and its predetermined horizontal position, by extending the length of said column.

22. The method of claim 18 which includes providing four suspension members, which suspension members are positioned generally equidistant about the axis of said column, and extending said suspension members angularly outwardly from the top of said column.

23. The method of claim 18 which includes providing adjustable turnbuckles disposed in each of said suspension members, and which method comprises adjusting the turnbuckle as required, to adjust the magnitude of the tensile force components of the said suspension members.

24. The method of claim 18 which includes providing a support member having a passageway therethrough and passing said column through said passageway in said support member, the support member secured to said structure, and suspending said suspension members from about the top of said column angularly downwardly and outwardly from the axis of said column, and securing the lower ends of said suspension members to said support member.

25. The method of claim 18 which includes providing a low-speed, high-torque motor and employing said motor to adjust the magnitude of the tensile forces on said suspension members.

* * * * *